United States Patent [19]

Donkers

[11] 4,133,120

[45] Jan. 9, 1979

[54] DREDGING APPARATUS WITH SPRING-SUPPORTED BUCKET LADDER

[75] Inventor: Jacobus M. Donkers, Zaandam, Netherlands

[73] Assignee: N.V. Industrieele Handelscombinatie Holland, Rotterdam, Netherlands

[21] Appl. No.: 805,432

[22] Filed: Jun. 10, 1977

[30] Foreign Application Priority Data

Jun. 10, 1976 [NL] Netherlands ..... 7606282

[51] Int. Cl.[2] ..... E02F 3/16

[52] U.S. Cl. ..... 37/69; 37/72

[58] Field of Search ..... 37/69, 72

[56] References Cited

U.S. PATENT DOCUMENTS 3,734,564 5/1973 McKay et al. ..... 37/69 X

FOREIGN PATENT DOCUMENTS 2308738 11/1976 France ..... 37/69

*Primary Examiner*—Clifford D. Crowder

*Attorney, Agent, or Firm*—Young & Thompson

[57] ABSTRACT

Dredging apparatus has a bucket ladder pivotally mounted thereon for vertical swinging movement about a horizontal axis. To stabilize the bucket ladder, the free end of the ladder is supported by a pulley and cable assembly which at its upper end is supported from the free arm of a lever pivotally mounted on the pontoon of the dredging apparatus. A hydro-pneumatic or pneumatic spring is pivotally mounted at one end on the pontoon and mounted for pivotal and sliding movement on and along a downwardly concave path on the lever at its other end, thereby to vary the point of application and hence the magnitude and direction of the spring force on the lever.

4 Claims, 1 Drawing Figure

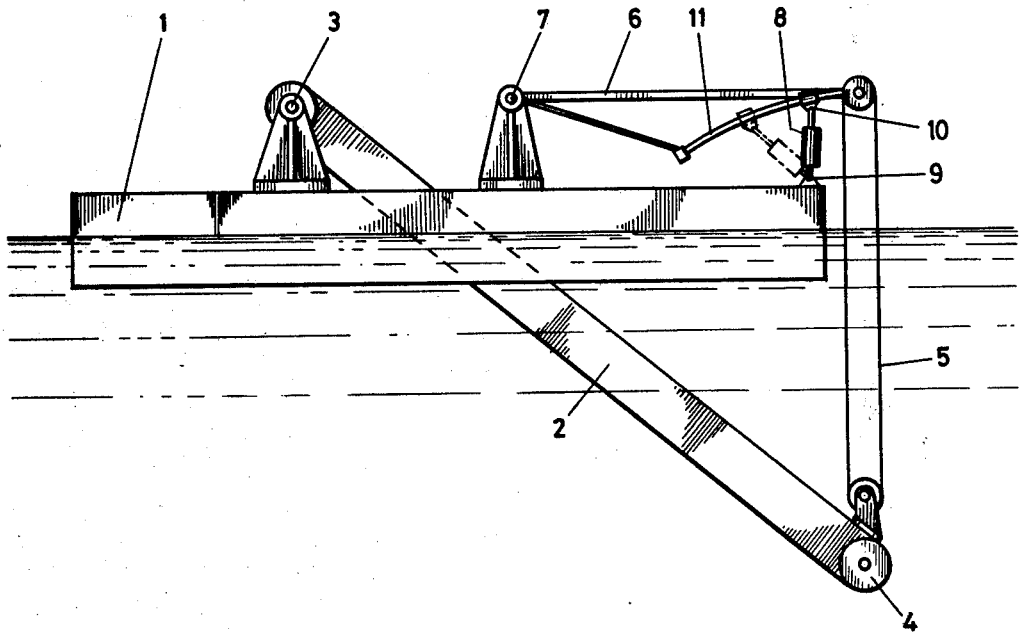
1
3
7
6
11
8
10
9
5
2
4

DREDGING APPARATUS WITH SPRING-SUPPORTED BUCKET LADDER

The invention relates to a dredging apparatus consisting of a pontoon, a bucket ladder pivotally connected with the pontoon, the lower and/or the upper end of said bucket ladder also being suspended from the pontoon via a pulley block with the intermediary of a spring, such as a hydro-pneumatic or a pneumatic spring. Such a dredging apparatus is known. Here, the spring has the function of a swell compensator which is necessary in order to allow the pontoon to move freely without seriously disturbing the contact of the excavating end of the ladder with the soil. Said swell compensator should be able to absorb considerable forces varying also according to the dredging depth and to variations in load (e.g. the filling of the buckets). In order to maintain the resilience as constant as possible, slack springs and, therefore, large air vessels will be required and a constant adjustment of load to the varying load conditions will be necessary in them. This requires much power and a complicated control apparatus.

The invention aims at improving upon this and, according to the invention, this is achieved by the upper pulley block being secured to the extremity of a lever pivotally connected with the pontoon, the spring being situated between the lever and the pontoon and the upper and/or lower end of the spring being movable longitudinally of the lever to and from the pivotal joint of the lever with the pontoon. By changing the points of support of the spring on the lever and/or on the pontoon, the lever ratio and/or the vector of force of the spring may be adjusted to the varying conditions. This control may be effected with a relatively small force since, while maintaining the adjusted load condition, only the point of application need be changed and, with that, the lever ratio and/or the vector of the load.

This is preferably effected by pivotally connecting an end of the spring with the pontoon and by allowing its upper end to move along a curved path on the lever. Preferably, said curved path will have a radius corresponding to the average length of the spring.

The invention will now be further illustrated with the aid of the drawing, which shows a diagrammatic side view of a dredging apparatus according to the invention, consisting of a pontoon 1, a ladder 2 pivotally connected with the pontoon at 3 and the front end 4 of which is secured to a lever 6 via a pulley and cable assembly 5, which lever is pivotally connected with the pontoon at 7.

Said lever is supported by a hydro-pneumatic spring 8, the lower end of which is pivotally connected with the pontoon at 9 and the upper end of which is secured to a slide 10 which is movable over the curved path or slideway 11.

By means of non-represented means, the spring 8 may be swung into a different position around the pivotal point 9, e.g. into the position indicated by broken lines. The spring will then act upon the lever at a shorter distance from the pivotal point 7 than in the position as indicated by full lines. An adjustment of this kind may be effected without much work, either electrically of hydraulically.

I claim:

1. Dredging apparatus comprising a pontoon, a bucket ladder pivotally connected with the pontoon, a pulley block assembly by which the lower end of said bucket ladder is supported, a lever pivotally mounted on the pontoon and supporting the upper end of the pulley block assembly, a spring pivotally interconnecting the pontoon and the lever, and means mounting one end of the spring for adjustive movement in a direction lengthwise of the lever.

2. Dredging apparatus as claimed in claim 1, one end of said spring being pivotally connected with the pontoon and the other end of said spring being pivotally connected with the lever, said mounting means comprising means mounting said other end of said spring on said lever for movement along said lever toward and away from the pivotal mounting of said lever on said pontoon.

3. Dredging apparatus as claimed in claim 2, and means defining a downwardly concave path of sliding movement on said lever to guide the upper end of said spring along said lever.

4. Dredging apparatus as claimed in claim 1, said spring being a fluid spring.

* * * * *